US006937828B2

(12) United States Patent
Hasegawa et al.

(10) Patent No.: US 6,937,828 B2
(45) Date of Patent: Aug. 30, 2005

(54) DUPLEX IMAGE FORMING APPARATUS WITH CONTROL OF HEAT SUPPLIED BY FIXING MEMBER

(75) Inventors: Kazuhiro Hasegawa, Ibaraki (JP); Masanori Akita, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/404,661

(22) Filed: Apr. 2, 2003

(65) Prior Publication Data

US 2003/0228167 A1 Dec. 11, 2003

(30) Foreign Application Priority Data

Apr. 4, 2002 (JP) ..... 2002-102728

(51) Int. Cl.[7] ..... G03G 15/20
(52) U.S. Cl. ..... 399/69; 399/401
(58) Field of Search ..... 399/67, 335, 69, 399/364, 401; 219/216, 469

(56) References Cited

U.S. PATENT DOCUMENTS 5,434,029 A * 7/1995 Moser ..... 219/216
5,512,993 A 4/1996 Endo et al.
5,991,563 A * 11/1999 Haneda et al. ..... 399/67
6,125,256 A * 9/2000 Ni et al.
6,493,522 B2 * 12/2002 Fujita
6,535,711 B2 * 3/2003 Rohde et al.

FOREIGN PATENT DOCUMENTS

JP 01202766 A * 8/1989 ..... G03G/15/00
JP 08087191 A * 4/1996 ..... G03G/15/20
JP 08194424 A * 7/1996 ..... G03G/21/14
JP 11184180 A * 7/1999 ..... G03G/15/00
JP 2003255755 A * 9/2003 ..... G03G/15/20

* cited by examiner

*Primary Examiner*—Susan Lee
(74) *Attorney, Agent, or Firm*—Fitzpatrick, Cella, Harper & Scinto

(57) ABSTRACT

In a dual-side image formation, a fixing apparatus has a fixing member for fixing an image on the recording material by heat, a heat supply member for supplying heat from the exterior of the fixing member, and a dual-side image forming unit which forms images on both sides of the recording material. A first image forming operation for forming an image on a first side of the recording material and a second image forming operation for forming an image on a second side of the recording material are executed repeatedly and a heat supply control controls heat supplied to the fixing member so that a heat supplying condition of the heat supply member is changed according to the side of the recording material when an image is fixed thereon.

8 Claims, 6 Drawing Sheets

DUPLEX IMAGE FORMING APPARATUS WITH CONTROL OF HEAT SUPPLIED BY FIXING MEMBER

BACKGROUND OF THE INVENTION

1. Field of the Invention

The present invention relates to an image forming apparatus including sheet feeding means which feeds a recording material toward a transfer area formed between an image bearing member and transfer means, and reversing means which reverses sides of a recording material subjected to an image transfer and an image fixation on a side thereof, for transfer on the other side, and again conveys it to the aforementioned transfer area, wherein continuous image formation is made on both sides of plural recording materials in the order of arrival to the transfer area.

2. Description of the Related Art

For forming images continuously on both sides of plural recording materials (such operation being hereinafter called dual-side continuous image formation), there has principally employed a method of at first executing an image transfer and a fixation continuously on one sides of the recording materials (this operation being hereinafter called one-side image formation), once stacking the recording materials subjected to the one-side image formation, on stacking means which can stack plural recording materials, and then forming images by executing an image transfer and a fixation continuously on the other sides of the recording materials stacked on the stacking means, simultaneously or substantially simultaneously with the completion of the one-side image formation on all the recording materials or after a predetermined time thereafter (such method being hereinafter called a stacking method).

In such stacking method, however, since there is required a certain space for the stacking means inside or outside the image forming apparatus and also since the recording materials subjected to the one-side image formation are to be once stacked on the stacking means until the one-side image formation is completed for all the recording materials, there inevitably result certain limits in the compactization of the image forming apparatus and in the reduction of the time required for image forming process, so that it has been difficult to the recently desired requirements for a compacter image forming apparatus or a faster image forming process.

Consequently there has recently been proposed, instead of the aforementioned stacking method, a method of executing image formation continuously on the plural recording materials in an order of arrival to a transfer area formed between a photosensitive drum serving as a latent image bearing member and transfer means, regardless whether the recording material is conveyed from sheet feeding means which feeds the recording material toward such transfer area, or conveyed from reversing means which reverses sides of the recording material subjected to an image transfer and an image fixation on a side thereof, for image formation on the other side, and again conveys it to the aforementioned transfer area (such method being hereinafter called through-path method). So, an image forming apparatus employing such through-path method has been commercialized to achieve compactization of the apparatus and a faster image forming process.

As a representative example of an image forming apparatus employing such through-path method, there is recently known an image forming apparatus 100 shown in FIG. 5, which is a schematic cross-sectional view of the image forming apparatus 100.

With respect to the image forming apparatus 100, the schematic configuration thereof will not be explained since such configuration is already known, and there will be given an explanation on an image forming process on both sides of a recording material, employed in the image forming apparatus 100 (such process being hereinafter called dual-side image forming process), and on a dual-side continuous image forming process by the through-path method.

At first there will be explained the dual-side image forming process in the image forming apparatus 100, with reference to FIG. 5.

In the dual-side image forming process in the image forming apparatus 100, at first analog image information of an original M, obtained by a scanning exposure with an original illuminating lamp 101 which is movably supported in a direction perpendicular to and in a horizontal direction of the plane of FIG. 5, is converted into digital image information by a CCD 102 which executes A/D conversion, and is stored in an image memory 103 which is capable of storing plural digital information.

Then a control mechanism 104, provided in the image forming apparatus 100, for controlling the functions of various devices, reads the digital image information as the basis of an image to be formed on a recording material, from the image memory 103 according to a predetermined control sequence, and outputs such information to a laser unit 106, which forms an electrostatic latent image corresponding to such digital image information on an external periphery of a photosensitive drum 105 serving as a latent image bearing member.

Receiving the digital image information from the image memory 103 under the control of the control mechanism 104, the laser unit 106 modulates a laser light La according to the entered digital image information, thereby irradiating the external periphery of the photosensitive drum 105 through certain changes in the laser light path.

On the other hand, prior to the laser irradiation by the laser unit 106, the external periphery of the photosensitive drum 105 is given a uniform potential distribution by a primary charger 107, and the irradiation of the laser light La by the laser unit 106 forms an electrostatic latent image corresponding to the given digital image information on the external periphery.

Then, the electrostatic latent image formed on the external periphery of the photosensitive drum 105 is subjected at a predetermined timing to a deposition of a developer from a developing apparatus 108 serving as developing means, and is thus developed into a visible image corresponding to the given digital image information.

Then, the visible image formed on the external periphery of the photosensitive drum 105 is subjected for example to a corona discharge from a transfer charger 109 serving as transfer means, and is transferred onto a side of a recording material which is conveyed at a predetermined timing from sheet cassettes 110, 111 constituting sheet supply means or from a manual insertion unit 112 to a transfer zone Z formed between the photosensitive drum 105 and the transfer charger 109, thus being recorded as an unfixed image corresponding to the given digital image information.

Then, the recording material bearing the aforementioned unfixed image on a side is conveyed, by a conveyor belt 113 provided in the image forming apparatus 100, from the transfer zone Z to a fixing nip N formed between two rollers supported rotatably and in capable of being mutual pressed contact in a fixing apparatus 114 for executing an image fixation by heat and pressure, namely between a cylindrical fixing roller 115 constituting fixing means and a circular rod-shaped pressure roller 116 constituting pressurizing means.

On the recording material arriving at the fixing nip N, the unfixed image is softened, fused and thus fixed by a heat supply from a heating member (not shown) provided as a heat source in a hollow portion of the fixing roller 115 and by a pressure from the pressure roller 116, with a color mixing into a desired color in case of a color image formation. Then the recording material is conveyed through a branching path 117 extending in the image forming apparatus 100 to a dual-side switchback mechanism 118 constituting reversing means which reverses the sides of the recording material, having the transferred and fixed image on a side, for image formation on the other side.

The recording material conveyed to the switchback mechanism 118 is subjected to a reversal of the side already bearing the transferred and fixed image and the other side, then is reconveyed to the transfer zone Z through a re-conveying path 119 extending in the image forming apparatus 100, further subjected to an aforementioned process from the image transfer to the fixation, and is discharged onto a discharge tray 120 supported on a side of the image forming apparatus 100, whereby a dual-side image forming process is completed.

In the following there will be explained, with reference to FIG. 6, a dual-side continuous image forming process by the through-path method in the aforementioned image forming apparatus 100, in an example of using 300 recording materials. The process from the image transfer on a side of each recording material to the fixation on the other side is same as the dual-side image forming process explained in the foregoing, and will not therefore be explained further.

In the dual-side continuous image forming process of the through-path method in the image forming apparatus 100, a unit cycle indicates a time required for image transfer and fixation on one sides of 5 recording materials, which are conveyed from the sheet cassette 110 or 111 (cf. FIG. 5) to the transfer zone in continuous manner with a predetermined interval corresponding to a time of 2 seconds. Such unit cycle is naturally determined by various parameters such as a length of a dual-side path, a longitudinal direction of the recording material, a process speed, etc.

At first, in a first cycle, images are formed by image transfer and fixation in succession on one sides of five recording materials a, b, c, d and e which are conveyed in continuous manner from the sheet cassette 110 or 111 to the transfer zone Z.

In a next second cycle, there are executed alternately (1) formations of unfixed images by image transfers on the other sides of the recording materials a, b, c, d and e which have been subjected to the image formation on one sides thereof and then conveyed to the transfer zone Z, and (2) formations of unfixed images by image transfers on one sides of five recording materials f, g, h, i and j which are conveyed newly in continuous manner from the sheet cassette 110 or 111 to the transfer zone Z.

Thus, in the second cycle, at first the recording material a, already bearing the transferred and fixed image on a side, is reversed in the switchback mechanism 118, then is reconveyed through the reconveying path 119 to the transfer zone Z, then is subjected to an image transfer and a fixation on the other side of the recording material and is discharged (or ejected) onto the discharge tray 120.

Then, after a predetermined time from the conveying of the recording material a to the transfer zone Z, for example after 1 second, a recording material f fed from the sheet cassette 110 or 111 is conveyed to the transfer zone Z, and, after an image transfer and a fixation on a side thereof, is conveyed through the branching path 117 to the switchback mechanism 118.

Then, after 1 second from the conveying of the recording material f to the transfer zone Z, the recording material b, already bearing the transferred and fixed image on a side and reversed in the switchback mechanism 118, is reconveyed through the reconveying path 119 to the transfer zone Z, then is subjected to an image transfer and a fixation on the other side thereof and is discharged onto the discharge tray 120. Thereafter the image transfer and fixation are executed in succession on a side of the recording material g, on the other side of the recording material c, on a side of the recording material h, on the other side of the recording material d, on a side of the recording material i, on the other side of the recording material e and on a side of the recording material j at a time interval of 1 second, whereby the second cycle is completed.

Thereafter, in 3rd to 58th cycles, a process similar to the second cycle is repeated, and, in a last 59th cycle, the five recording materials, each already bearing the transferred and fixed image on a side and reversed in the switchback mechanism 118, are reconveyed through the reconveying path 119 to the transfer zone Z, then are subjected to the image transfer and fixation on the other side of the recording materials and are discharged onto the discharge tray 120, whereby the dual-side image forming process on 300 recording materials is completed.

However, in an image forming method in which (1) recording materials being in an image forming process on a first side and (2) recording materials having the image already formed on the first side and being in an image forming process on a second side are processed in succession or in a random manner, as in the dual-side continuous image forming process of the aforementioned through-path method, the image fixed on the first side and the image fixed on the second side will be different in the surface luster or gloss in case the unfixed images formed on the sides of the recording material are fixed under a same fixing condition.

Such phenomenon may be ascribable to following facts.

An unfixed toner image on a recording material is fixed thereto by heat and pressure in the fixing step. For this reason, a moisture contained in the recording material evaporates by the heat. As a result, in a dual-side image formation on the recording material, the heat capacity of the recording material becomes different in the fixing step for the first side and that for the second side, because of a difference in the moisture contained in the recording material.

Also the recording material holds heat in the fixing step for the first side. Therefore, the temperature of the recording material in the fixing step is different for the fixing step for the first side and that for the second side. Stated differently, if the fixing condition is same for the first side and the second side, a larger amount of heat is given to the toner in the fixing step for the second side. Besides, in the dual-side continuous image forming process of the above-described through-path method, the recording material after the fixing step for the first side is subjected, after passing a dual-side conveying path, to the fixing step for the second side, so that the recording material has a higher temperature at the fixation of the unfixed image on the second side, and the temperature difference of the recording material becomes larger between the fixing step for the first side and that for the second side. It is therefore preferable to employ different fixing conditions for the image of the first side and that of the second side.

In the prior method of stacking the recording materials, after the image formation on the first sides, on the stacking means capable of stacking plural recording materials, and executing the image formations on the second sides after the image formation on the first sides of all the recording materials, it is possible to change the fixing condition for the first side and that for the second side, because the fixing operation for the images of the first sides and the fixing operation for the images of the second sides are executed separately.

However, in the dual-side continuous image forming process of the aforementioned through-path method, it is difficult to maintain an appropriate image by changing the fixing condition for the first side and for the second side, because the recording materials in the image forming process for the first side and the recording materials in the image forming process for the second side after the image formation on the first side are continuously processed in succession or in random manner. More specifically, as in such a configuration that the fixing roller comprises only a heat generating member such as a halogen heater, heat is supplied from the interior of the fixing roller to the surface thereof. This results in a following difficulty. In a control of elevating the surface temperature of the fixing roller for the fixation of the first side and reducing the surface temperature of the fixing roller for the fixation of the second side to a temperature lower than that for the fixation of the first side, in case of fixing an image formed on the side after fixing an image on the first side, the surface temperature of the fixing roller is not easily lowered before the fixing operation is executed. Thus, an elevation of the surface temperature of the fixing roller is possible within a short time by a heat supply thereto, but a reduction in the surface temperature has to wait until a predetermined amount of heat is dissipated. It is therefore difficult to arbitrarily control the elevation and reduction of the surface temperature of the fixing roller within a short time, by regulating the current supply to the heat generating member in the fixing roller.

SUMMARY OF THE INVENTION

An object of the present invention is to prevent a difference in the gloss between a first side and a second side of a recording material.

Another object of the present invention is to improve the productivity of images without a difference in gloss between a first side and a second side of a recording material.

Still another object of the present invention is to provide a fixing apparatus including:

a fixing member for fixing an image on a recording material by heat;

a heat supply member for supplying heat from the exterior of the fixing member;

dual-side image forming means which forms images on both sides of a recording material, wherein, in a dual-side image forming operation, a first image forming operation for forming an image on a first side of the recording material and a second image forming operation for forming an image on a second side of the recording material are executed repeatedly; and heat supply control means for controlling heat supplied to the fixing member, wherein a heat supplying condition of the heat supply member is changed according to the side of the recording material when an image is fixed thereon.

DETAILED DESCRIPTION OF THE PREFERRED EMBODIMENTS

In the following there will be explained embodiments of the present invention with reference to the accompanying drawings. In the following description, words employed therein have same definitions as in the foregoing explanation of the prior technology and will not be explained further.

(First Embodiment)

Figure 5:
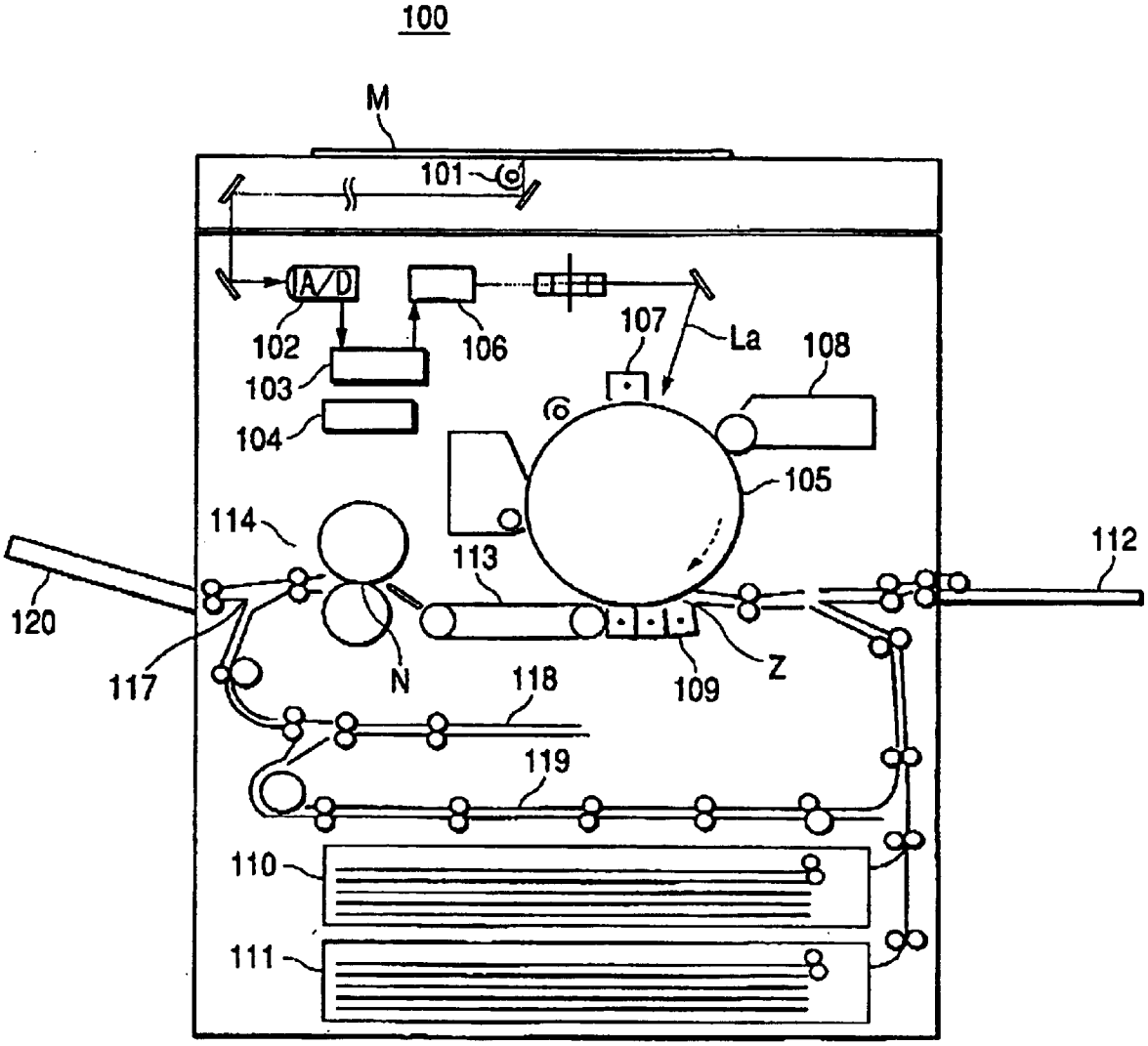
FIG. 5 PRIOR ART
FIG. 5 is a cross-sectional view showing a schematic configuration of a conventional image forming apparatus.
Figure 6:
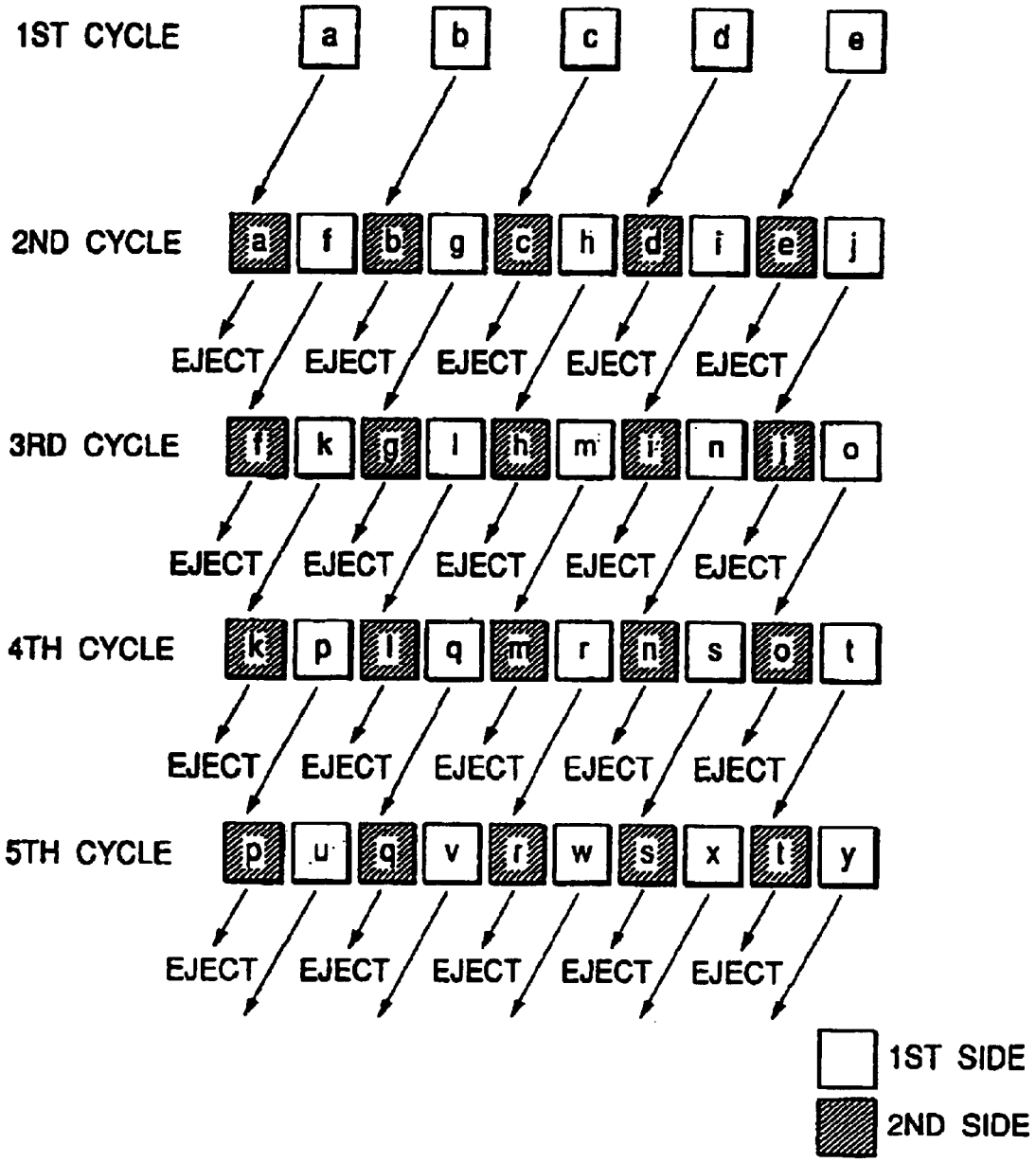
FIG. 6 PRIOR ART
FIG. 6 is a view showing an image forming procedure on recording materials based on a dual-side continuous image forming process employed in the image forming apparatus shown in FIG. 5.

At first, there will be given an explanation on a fixing apparatus 1, as a suitable example of the fixing apparatus 1 applied to an image forming apparatus of the first embodiment of the present invention. As the image forming unit, except for the fixing apparatus 1, has a schematic configuration similar to that of the image forming apparatus 100 constituting an example of the prior image forming apparatus, the configuration is represented by FIG. 5 except for the fixing apparatus 114 and will not be explained further.

Figure 1:
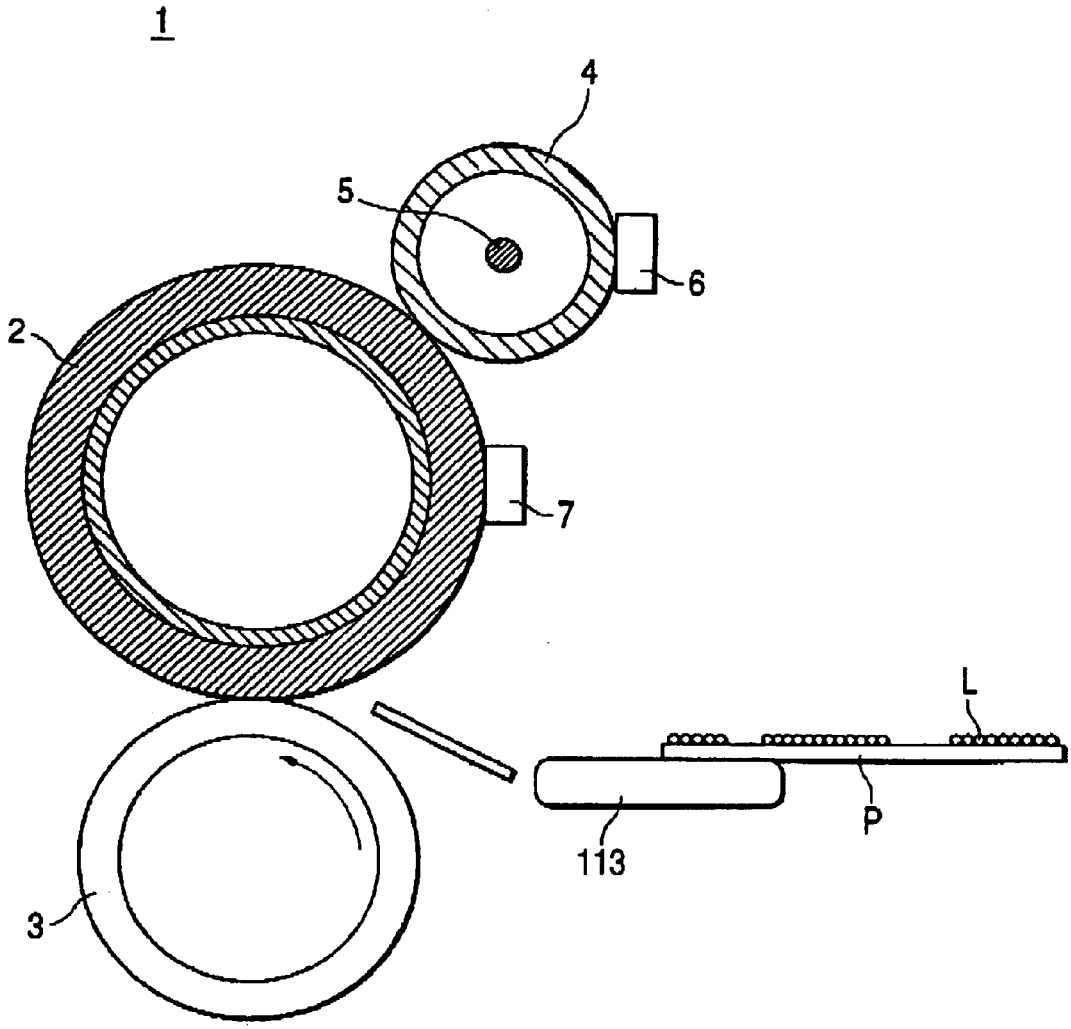
FIG. 1 is a cross-sectional view showing a schematic configuration of a fixing apparatus applied to an image forming apparatus in a first embodiment of the present invention.

In the fixing apparatus 1, as shown in FIG. 1, there are rotatably supported a fixing roller 2 formed in a cylindrical shape and constituting a fixing member, a pressure roller 3 formed in a circular rod shape and constituting a pressurizing member, and a heat roller 4 formed in a cylindrical shape and constituting an external heating roller serving as a heat supply member for heat supply to the fixing roller 2 while being pressed thereto. The pressure roller 3 is pressed to the fixing roller 2 by a pressurizing mechanism (not shown) provided in the image forming apparatus employing the fixing apparatus 1, and, between the fixing roller 2 and the pressure roller 3, there is formed a fixing nip portion N having a contact area for heat supply sufficient for fusing an unfixed image L on a recording material P for fixation thereto.

The fixing roller 2, supported in the aforementioned fixing apparatus 1, is formed by covering an external periphery of a cylindrical metal core of a metal having a satisfactory thermal conductivity such as aluminum, with an elastic layer formed by a material of satisfactory heat resistance and elasticity such as silicone rubber, and with releasing layer principally constituted by fluororubber in succession.

The heat roller 4, for supplying the fixing roller with heat, is formed by a metal cylinder of satisfactory thermal conductivity such as aluminum, and has a surfacial releasing layer for example of fluoric resin for increasing the releasing property. In a hollow portion of the heat roller, a heater 5 such as a halogen heater constituting a heat source is supported parallel to the axis of the heater roller 4, and, on the external periphery of the fixing roller 2 and the external periphery of the heat roller 4, temperature detecting elements 6, 7 serving as temperature detecting members for detecting the surface temperatures of these rollers are maintained in contact respectively therewith. In the present embodiment, a control mechanism 104 serving as heat supply control means controls the amount of current supply to the heater 5 based on the temperatures detected by the temperature detecting elements 6, 7, thereby controlling the surface temperature of the fixing roller 2. In the present embodiment, the heater 5 has an output power of 800 W.

On the other hand, the pressure roller 3, supported in the fixing apparatus, is formed by covering a circular rod-shaped member of a metal of satisfactory thermal conductivity such as aluminum, with an elastic layer formed by a material of satisfactory heat resistance and elasticity such as silicone rubber, and there is formed thereon a surfacial releasing layer for example of fluoric resin for improving the releasing property. It is pressed to the fixing roller 2 by the aforementioned pressurizing mechanism, and is rotated at a predetermined peripheral speed by a driving mechanism (not shown) provided in the image forming apparatus including the fixing apparatus 1, whereby, at the fixing operation, the fixing roller 2 is rotated according to the rotation of the pressure roller 3 and the recording material bearing the unfixed image is pinched and conveyed by the fixing roller 2 and the pressure roller 3 through the fixing nip portion N. There may also be employed a driving method of driving the fixing roller.

Since the heat roller 4 provided outside the fixing roller 2 is so constructed as to supply heat to the surface of the fixing roller 2, the surface temperature of the fixing roller 2, governing the amount of heat given to the recording material at the fixing operation, responds to the surface temperature of the heat roller 4 with a satisfactory responsiveness.

In the dual-side continuous image forming operation by the through-path method of the prior art, because the fixing condition is same for the first side and the second side, an excessive heat is given to the toner in the fixing step of the second side, whereby the fixed images on the first and second sides are significantly different in gloss and image formation with a maintained quality cannot be achieved.

In the present embodiment, therefore, in order to solve the above-mentioned drawback, the control mechanism 104 is provided with first current supply control means which controls a current supply (an energization) to the heater so as to maintain the surface temperature of the fixing roller at a predetermined value based on the temperatures detected by the temperature detecting elements 6, 7, and second current supply control means which controls the current supply to the heater by judging whether the first side or the second side of the recording material enters the fixing step, thereby controlling the heater according to the result of judgment in the dual-side continuous image forming operation of through-path method.

The first current supply control means in the present embodiment executes a current supply (an energization) to the heater in such a manner that the surface temperature of the fixing roller 2 at the fixing operation is within a range of 180 to 200° C.

Also the second control means does not execute the current supply to the heater 5 regardless of the temperature of the fixing roller 2, or turns off the current supply to the heater 5 after confirming that the temperature of the fixing roller 2 is equal to or higher than a predetermined value (160° C. in the present embodiment).

Figure 2:
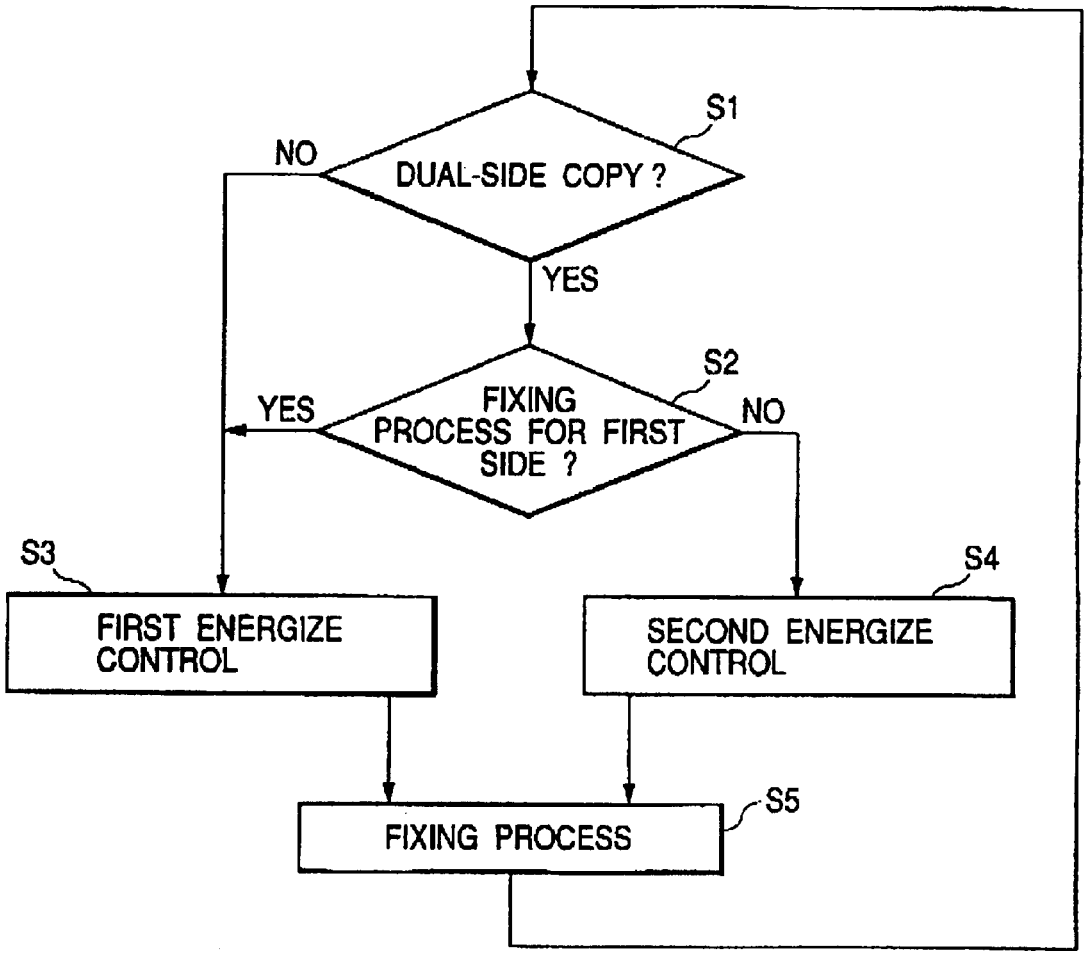
FIG. 2 is a flow chart showing a fixing procedure at an image formation on a recording material in the fixing apparatus applied to the image forming apparatus in the first embodiment of the present invention.

Now reference is made to FIG. 2 for explaining a specific flow in a continuous image forming operation.

At first, prior to the introduction of a recording material in the fixing step, a step S1 discriminates whether a dual-side image formation or a one-side image formation is executed.

In case of a one-side image formation, a step S3 executes a first current supply control (a first energize control) (ordinary current supply control) thereby controlling the current supply to the heater 5 so as to maintain the fixing roller 2 at a predetermined temperature (180° C. in the present embodiment).

On the other hand, in case the step S1 identifies a dual-side image formation, a step S2 discriminates whether the recording material is in a fixing step for a first side or in a fixing step for a second side.

In case a first side is identified, the fixing step is executed with the first current supply control of the step S3 as in the one-side image formation.

In case a second side is identified, a second current supply control of a step S4 is utilized to execute a fixing step of a step S5, namely by cutting off the current supply to the heater 5.

As explained in the foregoing, a configuration and a control of the fixing apparatus capable of instantaneously changing the surface temperature of the fixing roller 2 allow to effectively reduce the amount of heat supplied to the toner image on the second side in the continuous image formation of through-path method, thereby suppressing the difference in gloss between the fixed images of the first and second sides and enabling image formation with maintained quality.

(Second Embodiment)

In the following there will be explained an image forming apparatus constituting a second embodiment of the present invention.

As the image forming unit, except for the fixing apparatus 3, has a schematic configuration similar to that of the image forming apparatus 100 constituting an example of the prior image forming apparatus, the configuration is represented by FIG. 5 except for the fixing apparatus 114 and will not be explained further.

In the dual-side continuous image forming process of the through-path method, in order to suppress the difference in gloss between the fixed images on the first side and the second side, it has been necessary, as explained in the foregoing, to change the fixing condition for the first side and for the second side. More specifically, there is required a configuration capable of reducing the temperature of the fixing roller 2 at the fixing operation for the second side.

However, when the image forming speed is increased, the temperature difference of the recording material between the fixing step for the first side and that for the second side becomes more conspicuous, so that the configuration of the first embodiment is unable to sufficiently suppress the difference in the gloss between the first side and the second side.

Therefore, the present embodiment is featured, in the configuration of the fixing apparatus of the first embodiment, by an attach/detaching mechanism for the heat roller 4. As explained in the foregoing, the surface temperature of the heat roller 4 changes with a satisfactory responsiveness by the on/off state of the current supply to the heater 5. However such response is insufficient for a high-speed system and an attach/detaching mechanism is required.

Figure 3:
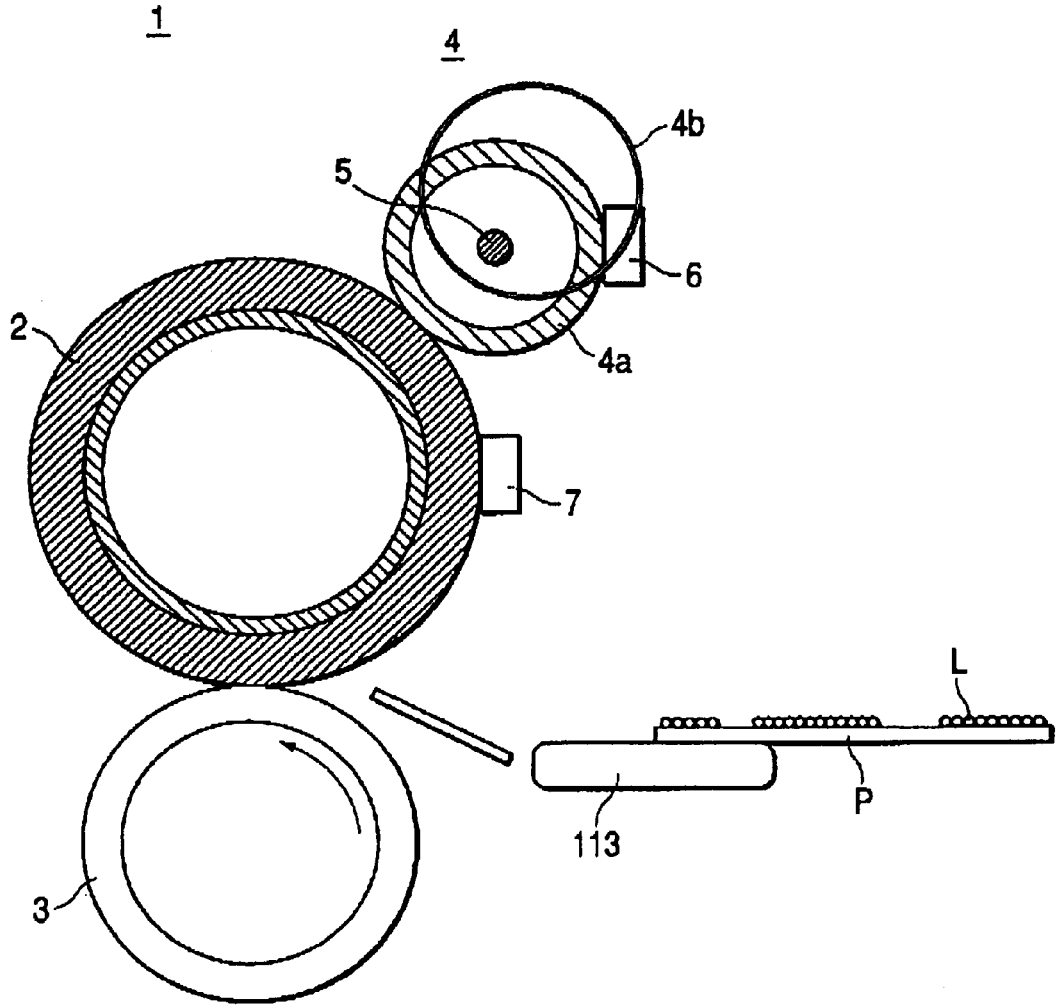
FIG. 3 is a cross-sectional view showing a schematic configuration of a fixing apparatus applied to an image forming apparatus in a second embodiment of the present invention.

As shown in FIG. 3, the heat roller 4 is moved between two positions, namely a position 4*a* in contact with the fixing roller 2 and a broken-lined position 4*b* separated from the fixing roller 2.

Figure 4:
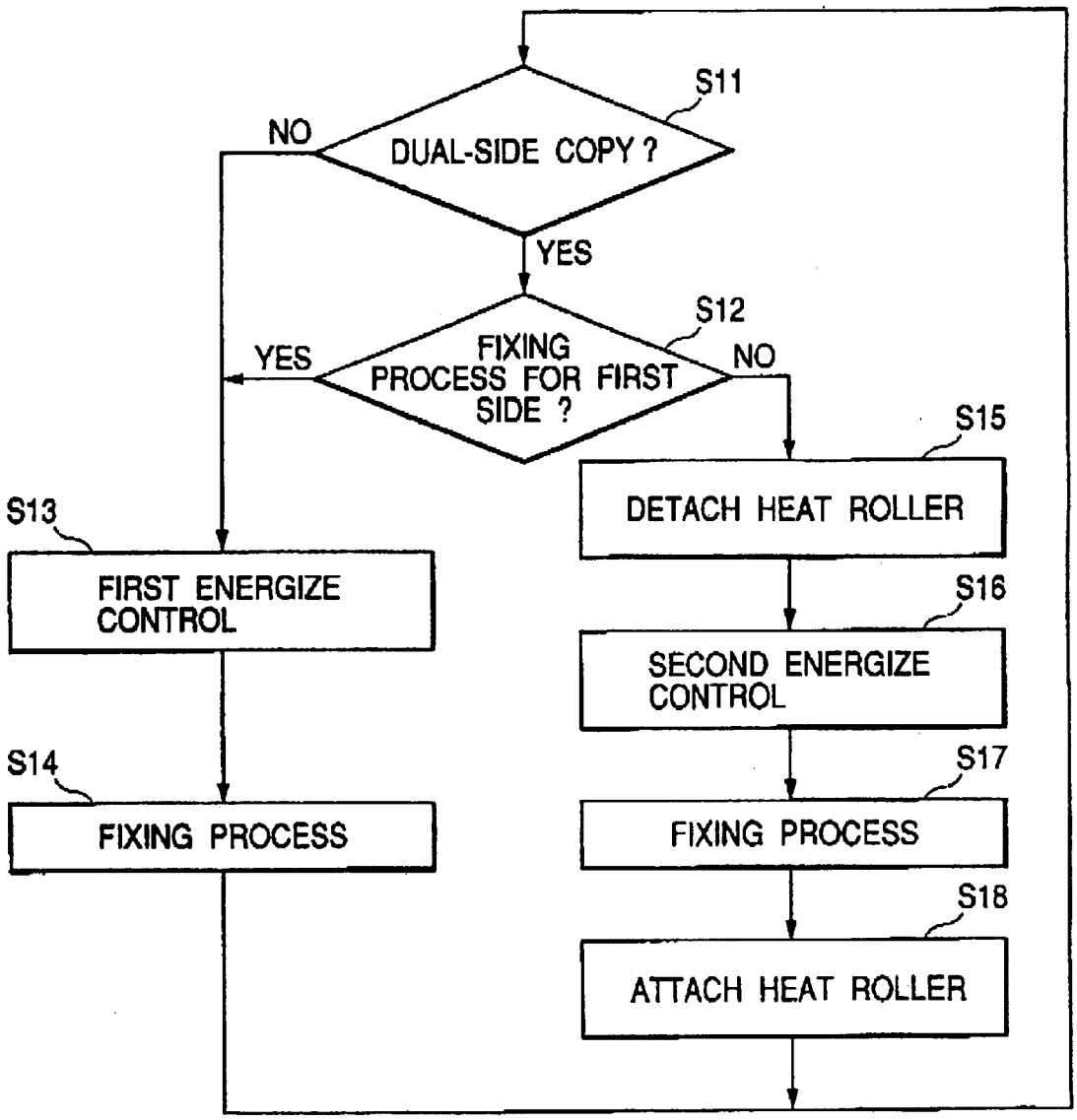
FIG. 4 is a flow chart showing a fixing procedure at an image formation on a recording material in the fixing apparatus applied to the image forming apparatus in the second embodiment of the present invention.

A fixing process in an actual image formation will be explained with reference to FIG. 4.

At first, prior to the introduction of a recording material in the fixing step, a step S11 discriminates whether a dual-side image formation or a one-side image formation is executed.

In case of a one-side image formation, a step S13 executes a first current supply control (ordinary current supply control) for turning on and off the current supply to the heater so as to maintain the fixing roller 2 at a predetermined temperature (180° C. in the present embodiment) (fixing step in a step S14).

On the other hand, in case the step S11 identifies a dual-side image formation, a step S12 discriminates whether the recording material is in a fixing step for a first side or in a fixing step for a second side.

In case a first side is identified, the first current supply control of the step S13 as in the one-side image formation is executed the fixing step (step S14).

In case a second side is identified, the heat roller 4 is moved from the position 4*a* in contact with the fixing roller to the position 4*b* separated from the fixing roller (step S15) and then a second current supply control of a step S16 is utilized to execute a fixing step of a step S17. Thereafter the heat roller 4 returns to the position 4*a* (step S18).

A similar effect can also be obtained by the attach/detaching mechanism only, omitting the current supply control in order to simplify the configuration.

As explained in the foregoing, a configuration and a control of the fixing apparatus capable of instantaneously changing the surface temperature of the fixing roller 2 allow to effectively reduce the amount of heat supplied to the toner image on the second side in the continuous image formation of through-path method, thereby suppressing the difference in gloss between the fixed images of the first and second sides and enabling image formation with maintained quality.

The numerical values cited in the first and second embodiments are cited merely for simplifying the description, and may be varied within the scope of the present invention.

Also, the first embodiment employs a contact heating method with a heat roller, but other heating methods or non-contact heating methods can naturally obtain a similar effect by adopting the first and second control means explained in the foregoing.

As explained in the foregoing, even in the dual-side continuous image forming process with the through-path method, the present invention allows to suppress the difference in gloss between the fixed images of the first and second sides of the recording material, thereby enabling image formation with maintained quality.

Also according to the present invention, in the fixing apparatus of the aforementioned configuration, a configuration enabling the heat supply member and the fixing member to be mutually attached or detached allows to similarly suppress the difference in gloss between the fixed images of the first and second sides of the recording material, thereby enabling image formation with maintained quality, even in dual-side continuous image forming process with a high speed image formation.

The present invention has been explained by embodiments thereof, but the present invention is not limited to such embodiment and is subjected to any and all modifications within the technical scope of the present invention.

What is claimed is:

1. An image forming apparatus comprising:

image forming means for forming an unfixed image on a recording material;

a fixing member for fixing the unfixed image on the recording material at a fixing position, wherein said fixing member is capable of conducting the fixation on a first side of the recording material, and the fixation on a second side of the recording material, opposed to the first side on which an image has been fixed;

a heat supply member for supplying heat from an exterior of the fixing member at a heating position which is different from said fixing position; and control means for controlling an amount of heat supplied from said heat supply member to said fixing member so that the heat amount for the fixation on the second side is smaller than that for the fixation on the first side.

2. An apparatus according to claim 1, wherein said fixing member is capable of alternately conducting the fixation on the first side of the recording material and conducting the fixation on the second side opposite to the first side on which the image has been fixed.

3. An apparatus according to claim 1, wherein when dual-side continuous image formation is conducted onto a plurality of recording materials, said image forming means is capable of executing an image forming operation onto the second side of the recording material a predetermined number of times every time it has executed an image forming on the first side of the recording material a predetermined number of times.

4. An apparatus according to claim 3, wherein said image forming means is capable of alternately executing an image forming operation on the first side of the recording material and on the second side of the recording material.

5. An apparatus according to claim 1, wherein a temperature of said heat supply member at the fixation on the second side is lower than a temperature of said heat supply member at the fixation on the first side.

6. An apparatus according to claim 1, wherein said heat supply member is not in contact with the fixing member at the fixation on the second side.

7. An apparatus according to claim 1, further comprising a nip forming member for forming a nip at the fixing position for pinching and conveying the recording material between said fixing member and said nip forming member.

8. An apparatus according to claim 1, further comprising a heat supply member for supplying heat to said fixing member from an interior of said fixing member.

* * * * *

UNITED STATES PATENT AND TRADEMARK OFFICE

CERTIFICATE OF CORRECTION

PATENT NO. : 6,937,828 B2
DATED : August 30, 2005
INVENTOR(S) : Kazuhiro Hasegawa et al.

It is certified that error appears in the above-identified patent and that said Letters Patent is hereby corrected as shown below:

Title page,
Item [56], References Cited, FOREIGN PATENT DOCUMENTS,
"01202766 A" should read -- 01-202766 A --;
"08087191 A" should read -- 08-087191 A --;
"08194424 A" should read -- 08-194424 A --;
"11184180 A" should read -- 11-184180 A --; and
"2003255755 A" should read -- 2003-255755 A --.

Column 1,
Line 22, "sides" should read -- side --.

Column 3,
Lines 37, 45, 52 and 54, "sides" should read -- side --.

Signed and Sealed this

Twenty-eighth Day of March, 2006

JON W. DUDAS
*Director of the United States Patent and Trademark Office*